US010965070B2

(12) United States Patent
Shi et al.

(10) Patent No.: US 10,965,070 B2
(45) Date of Patent: Mar. 30, 2021

(54) QUICK DEMOUNTABLE HIGH-RELIABILITY RADIO-FREQUENCY COAXIAL CONNECTOR

(71) Applicant: Jiangsu Hengxin Technology Co., Ltd, Yixing (CN)

(72) Inventors: Ke Shi, Yixing (CN); GuoQiang Xu, Yixing (CN); YongKun Liu, Yixing (CN); WenBiao Dong, Yixing (CN); Kai Zhu, Yixing (CN); ChongHui Huang, Yixing (CN)

(73) Assignee: Jiangsu Hengxin Technology Co., Ltd., Yixing (CN)

( * ) Notice: Subject to any disclaimer, the term of this patent is extended or adjusted under 35 U.S.C. 154(b) by 53 days.

(21) Appl. No.: 16/474,871

(22) PCT Filed: Aug. 27, 2018

(86) PCT No.: PCT/CN2018/102436
§ 371 (c)(1),
(2) Date: Jun. 28, 2019

(87) PCT Pub. No.: WO2010/029340
PCT Pub. Date: Feb. 13, 2020

(65) Prior Publication Data

US 2020/0358231 A1 Nov. 12, 2020

(30) Foreign Application Priority Data

Aug. 7, 2018 (CN) ..... 201810892598.8

(51) Int. Cl.
*H01R 9/05* (2006.01)
*H01R 24/40* (2011.01)
(Continued)

(52) U.S. Cl.
CPC ..... *H01R 24/40* (2013.01); *H01R 13/415* (2013.01); *H01R 13/502* (2013.01); *H01R 2103/00* (2013.01)

(58) Field of Classification Search
CPC . H01R 2103/00; H01R 9/0521; H01R 9/0518
(Continued)

(56) References Cited

U.S. PATENT DOCUMENTS 3,792,419 A * 2/1974 Spinner ..... H01R 24/40 439/584
5,785,554 A * 7/1998 Ohshiro ..... H01R 13/5205 439/583

(Continued)

FOREIGN PATENT DOCUMENTS

CN 101127416 A 2/2008
CN 201408894 Y 2/2010

(Continued)

*Primary Examiner* — Thanh Tam T Le

(57) ABSTRACT

A quick demountable high-reliability radio-frequency coaxial connector including a front shell and a rear protective jacket, a cavity of the front shell is internally provided with a front insulator and a central conductor, a first locating hole of a central axial position of the front insulator, the center of the front end of the central conductor is provided with a front protrusion, the front protrusion is arranged towards the first locating hole, a penetration hole is formed in a central part of the axial tail of the central conductor, the axial tail is a necking conical structure, the inner diameter of the outer end of the necking conical structure is smaller than that of an inner conductor of a cable, and meanwhile, the inner diameter of the inner end of the necking conical structure is larger than that of the inner conductor of the cable.

9 Claims, 8 Drawing Sheets

(51) Int. Cl.
*H01R 13/415* (2006.01)
*H01R 13/502* (2006.01)
*H01R 103/00* (2006.01)

(58) Field of Classification Search
USPC ..... 439/578, 583–585
See application file for complete search history.

(56) References Cited

U.S. PATENT DOCUMENTS 5,795,188 A * 8/1998 Harwath ..... H01R 24/566 439/583
5,871,372 A * 2/1999 Kanda ..... H01R 24/564 439/583
7,121,872 B1 * 10/2006 Hanks ..... H01R 24/28 439/427
7,931,499 B2 * 4/2011 Islam ..... H01R 24/566 439/584
7,934,954 B1 * 5/2011 Chawgo ..... H01R 24/56 439/578
8,047,870 B2 * 11/2011 Clausen ..... H01R 24/564 439/578
8,333,612 B2 * 12/2012 Natoli ..... H01R 24/564 439/578
8,435,073 B2 * 5/2013 Wild ..... H01R 9/0521 439/578
8,449,327 B2 * 5/2013 Low ..... H01R 9/0521 439/579
8,454,383 B2 * 6/2013 Paynter ..... H01R 13/5804 439/578
8,678,858 B2 * 3/2014 Islam ..... H01R 9/0521 439/578
9,166,306 B2 * 10/2015 Montena ..... H01R 24/56
10,177,469 B2 * 1/2019 Wu ..... H02G 15/085
2012/0003869 A1 1/2012 Ehret et al.

FOREIGN PATENT DOCUMENTS

CN 107331984 A 11/2017
CN 107800009 A 3/2018

* cited by examiner

QUICK DEMOUNTABLE HIGH-RELIABILITY RADIO-FREQUENCY COAXIAL CONNECTOR

CROSS REFERENCE TO RELATED APPLICATIONS

This application is a national stage application under 35 U.S.C. 371 of PCT Application No. PCT/CN2018/102436, Filed on 27 Aug. 2018, which PCT application claimed the benefit of Chinese Patent Application No. 2018108925988 filed 7 Aug. 2018, the entire disclosure of each of which are hereby incorporated herein by reference.

TECHNICAL FIELD

The present disclosure relates to the technical field of radio-frequency coaxial cable connectors and particularly relates to a quick demountable high-reliability radio-frequency coaxial connector.

BACKGROUND

In the industry, a radio-frequency coaxial cable connector commonly comprises an installation type, a soldering type and a crimp-connection type. The traditional installation-type connector adopts a threaded-connection structure, which can be conveniently disassembled. Although its cost is much higher than the other two, but its advantage is that it is flexible in the construction of the project and can be adjusted according to the actual length or connection type. According to the investigation, for a skilled operator spends 2-3 minutes in installing one connector. For a novice who needs to follow the instruction manual, the process usually takes more than 10-15 minutes. Under the circumstances, the connector may not be installed improperly, resulting in a poor operating performance index.

At present, the internal structure of the same-model connectors sold in domestic is nearly the same as that sold in abroad, and their shortcomings on the electrical performance are also basically consistent, especially in the industry with more dynamic intermodulation. In view of the problem of dynamic intermodulation, we have also carried out more experimental analysis. In addition to the factors such as the material and the electroplating, it is mainly affected by the clamping force that the connector cable clamp imposes on the cable outer conductor, and the clamping force that the connector jack imposes on the cable inner conductor. The cable outer conductor is only partially clamped by the connector, and the gap between the other parts of the connector and the cable outer conductor is large. Due to the shaking of the cable outer conductor, mutual adjustment is not stable under the dynamic condition. Likewise, the cable inner conductor is not sufficiently clamped. The aforesaid are two main factors that affect the stability of the dynamic intermodulation.

With the increasing requirements of the base station system for the performance of each component and the increasing cost of artificial construction, it's urgent for those skilled in the art to develop a novel connector that has a high stability and can be conveniently installed.

SUMMARY

With respect to above issues, the present disclosure provides a quick demountable high-reliability radio-frequency coaxial connector which is simple and rapid in mounting, high in mechanical structure stability and high in working reliability so that the product competitiveness is improved.

The quick demountable high-reliability radio-frequency coaxial connector comprises a front shell and a rear protective jacket, wherein a cavity of the front shell is internally provided with a front insulator and a central conductor, the front insulator and the central conductor are arranged in a front-rear sequence, a first locating hole is formed in a central axial position of the front insulator, the center of the front end of the central conductor is provided with a front protrusion, the front protrusion is arranged towards the first locating hole, the open grooves are uniformly distributed on the outer ring surface of an axial tail of the central conductor, a penetration hole is formed in a central part of the axial tail of the central conductor, the axial tail of the central conductor is specifically a necking conical structure, the inner diameter of the outer end of the necking conical structure is smaller than that of an inner conductor of a cable, meanwhile, the inner diameter of the inner end of the necking conical structure is larger than that of the inner conductor of the cable, a rear outer ring surface of the front shell and a front inner ring surface of the rear protective jacket are located and connected by an interference fit, an inner cavity of the rear protective jacket is internally provided with a cable clamp assembly, a front end clamping surface formed by the cable clamp assembly is used for clamping an outer ring surface of an outer conductor of a to-be-connected cable, a clamping inner concave ring groove which is forwardly concave is formed in the inner side of a rear end inner ring surface of the front shell, and a lock catch part of the clamping inner concave ring groove is of a backward sharp corner structure.

The inner side of a stop protrusion on the rear outer ring surface of the front shell is sleeved with a first sealing ring, and an outer ring surface of the first sealing ring abuts to an inner ring surface of the rear protective jacket after the cable is connected in place, so that an in-place packaging can be achieved.

The front protrusion is connected with the first locating hole by an interference fit in a mounting state.

The cable clamp assembly comprises a base and a cable clamp, an outer ring surface of the base is connected with the corresponding inner ring surface of the rear protective jacket by an interference fit, mounting hook structures at the rear end of the cable clamp are clamped in slotted holes in the corresponding outer ring surface of the base, each of the front and rear of the inner end ring surface of the cable clamp is provided with a first inner ring protrusion and a second inner ring protrusion, the first inner ring protrusion and the second inner ring protrusion are used for crimping corresponding troughs of the cable mounted in place, and the front end surface of the cable clamp is a clamping surface corresponding to the corresponding clamping inner concave ring groove of the front shell.

The cable clamp is specifically of a circular ring structure formed by circumferentially splicing a plurality of lobes of cable clamp structures, and the mounting hook structures at the rear ends of the cable clamp structures are located in the corresponding slotted holes.

The inner wall of each of the cable clamp structures from a sectional view comprises a first protrusion, an inner concave section and a second protrusion which together form a clamping structure, the first protrusions of the plurality of cable clamp structures are combined to form the first inner ring protrusion, and the second protrusions of the plurality of cable clamp structures are combined to form the second inner ring protrusion.

The front end outer ring surface of the cable clamp is sleeved with a cable clamp fastening ring, and an outer ring surface formed by the cable clamp is pushed into an inner cavity at the rear end of the front shell after the cable is connected in place.

The base comprises an axial rear protruded ring inserted into a mounting groove corresponding to a rear mounting sleeve, a sealing ring is arranged between the rear end of the axial rear protruded ring and the inner end wall of the mounting groove, and an inner ring surface of the sealing ring simultaneously sleeves an outer ring surface of a sheath of the to-be-connected cable in a working state so that the waterproof performance is achieved.

And a gap is remained between the rear end surface of a main body of the base and the corresponding locating end surface of the rear mounting sleeve during a pre-mounting process, a cross-section of a rear end inner ring surface of the axial rear protruded ring is a slope, and the rear end surface of the main body of the base and the locating end surface of the rear protective jacket are used as limiting surfaces in a crimping process, so that the sealing ring is deformed under force in the crimping process to achieve a sealing effect.

With the structure of the disclosure, the cable to be connected, needs to be stripped and pre-installed first, then, the cable is inserted into a coaxial connector, the inner conductor of the cable has to be in the penetration hole of the axial tail of the central conductor, the inner conductor of the cable has to enter the penetration hole of the central conductor while keeping the concentricity. In a subsequent crimp-to-connect process, the outer conductor of the cable is abutted against the sharp corner structure, the outer conductor of the cable is extruded to bend and deform, the outer conductor is overlapped and is clamped between the front end clamping surface of the cable clamp assembly and the clamping inner concave ring groove, the cable displaces when a crimping force acting on the cable is large enough, thereby pushing the center conductor to move forward, consequently pushing the center conductor into the first positioning hole so that the cable inner conductor can be better fastened. Furthermore, as the connector is pre-installed, unscrewing to separate the front and rear shells and reinstalling them are no longer needed. It just needs to insert the cable, which is stripped in advance according to dimensional requirements, into the connector, and crimp-to-connect them by a tool, the process is a quick and simple. The front and rear shells of the present disclosure are connected by an interference fit, many tests show that the tensile strength of the connector according to the disclosure is much greater than that of the conventional thread-connection structure.

Figure 1:
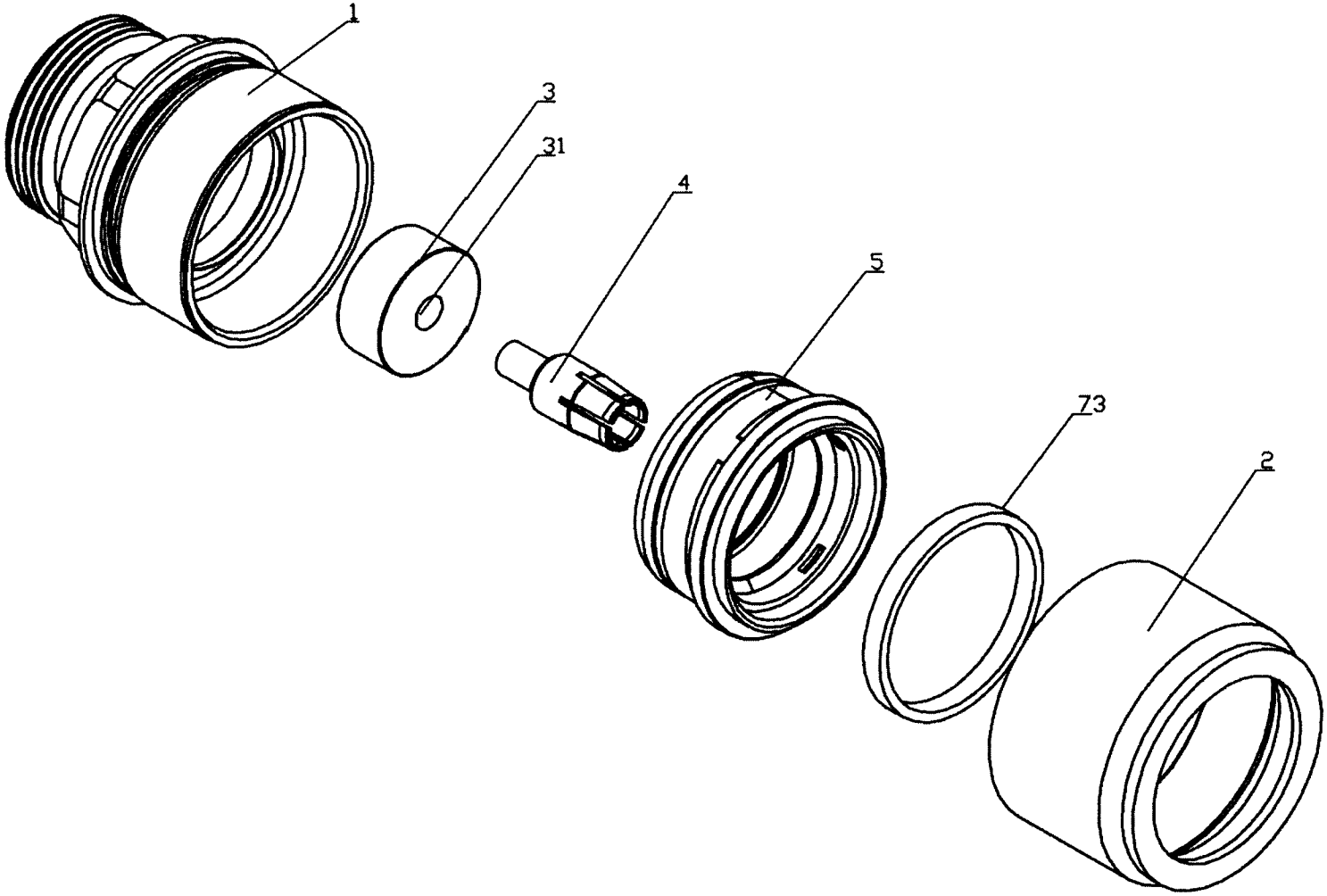
FIG. 1 is a perspective exploded view of the present disclosure.
Figure 2:
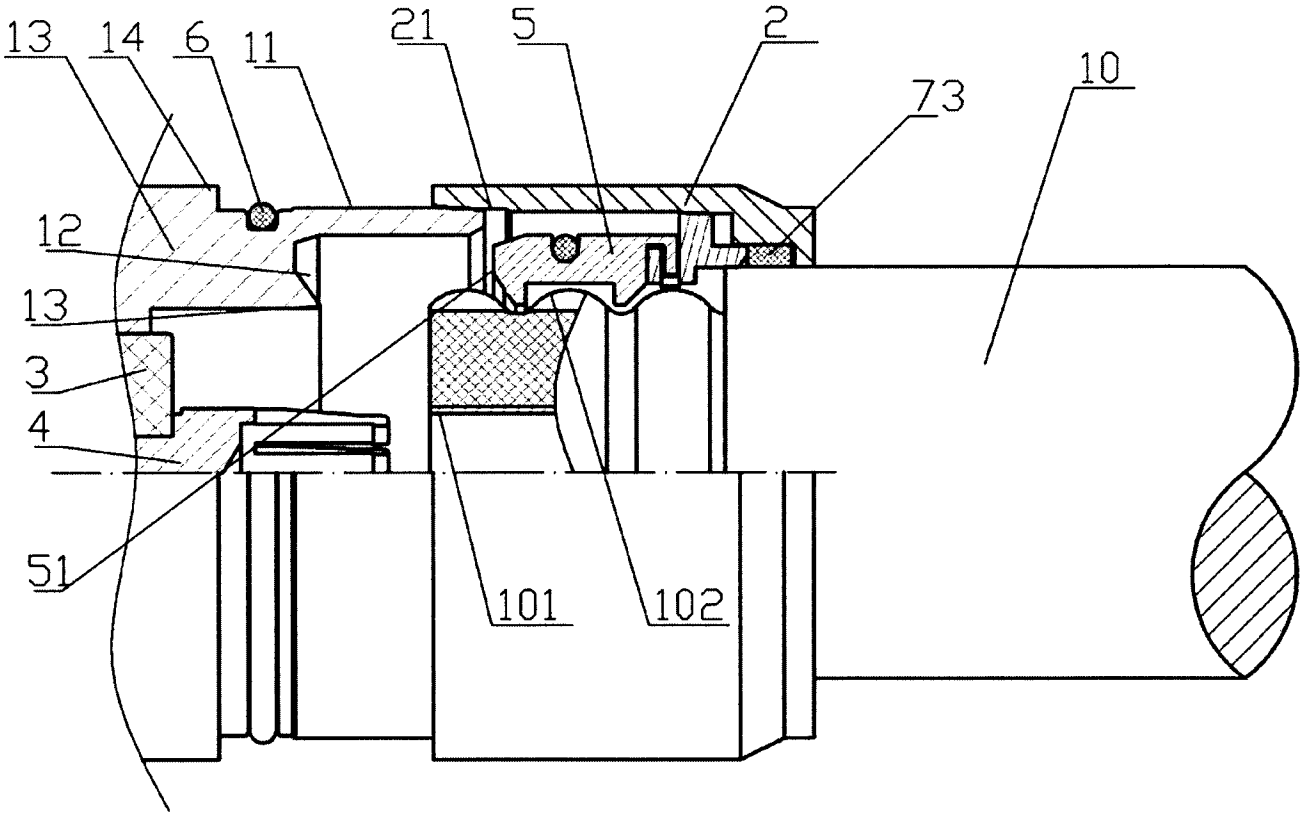
FIG. 2 is a schematic diagram of a sectional structure of a front view of the present disclosure.
Figure 3:
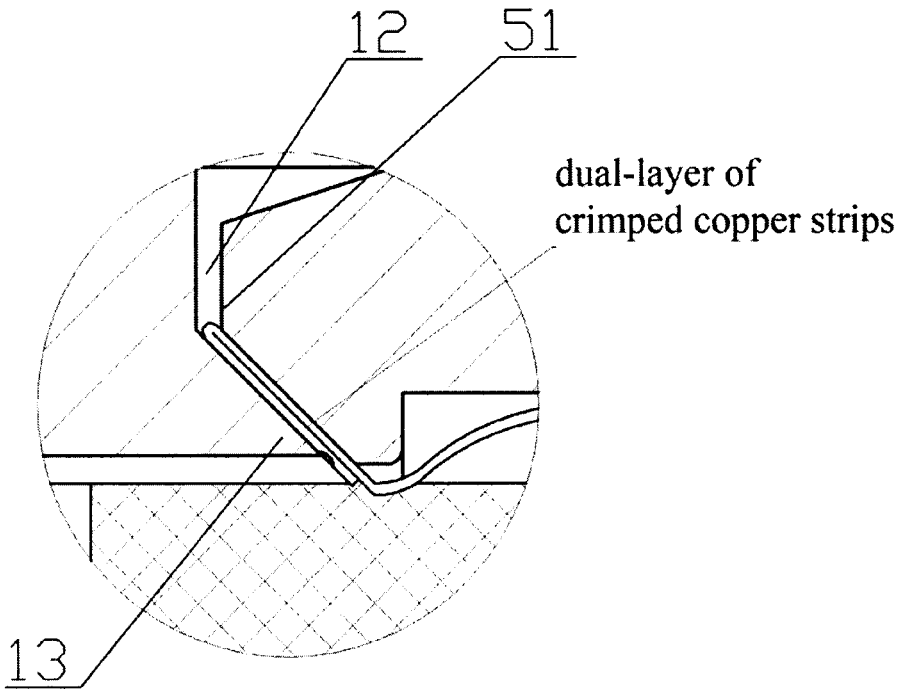
FIG. 3 is a schematic diagram of a three-dimensional structure of a cable clamp assembly of the present disclosure.
Figure 4:
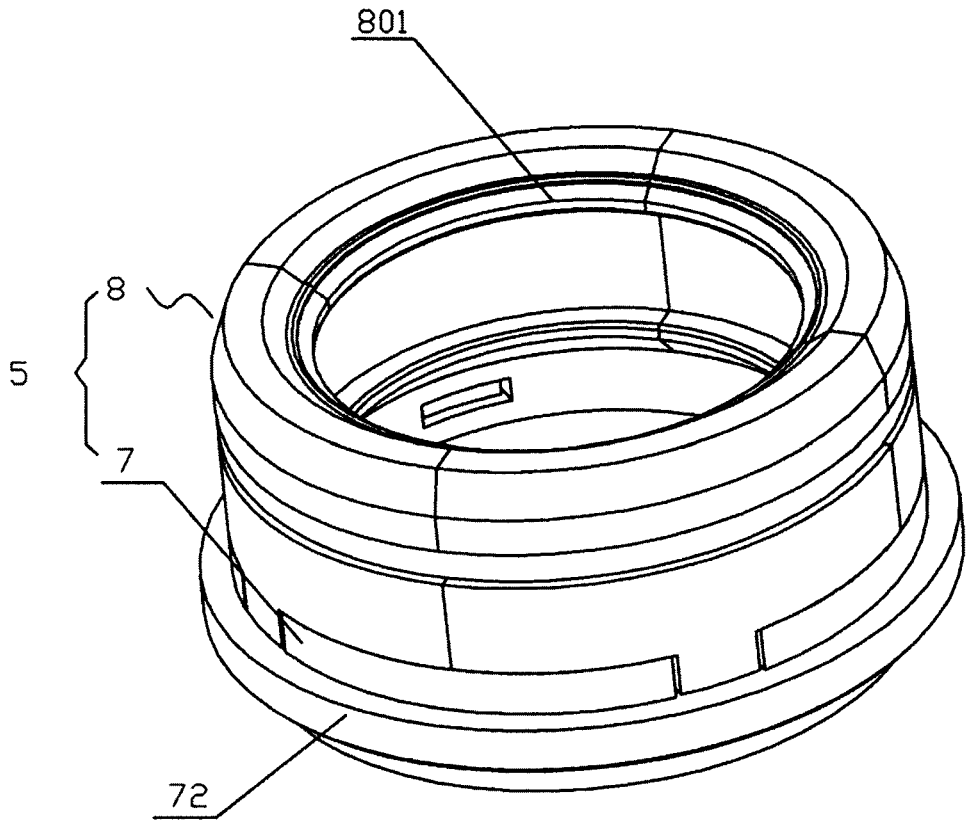
FIG. 4 is a schematic diagram of a three-dimensional exploded structure of the cable clamp assembly of the present disclosure.
Figure 5:
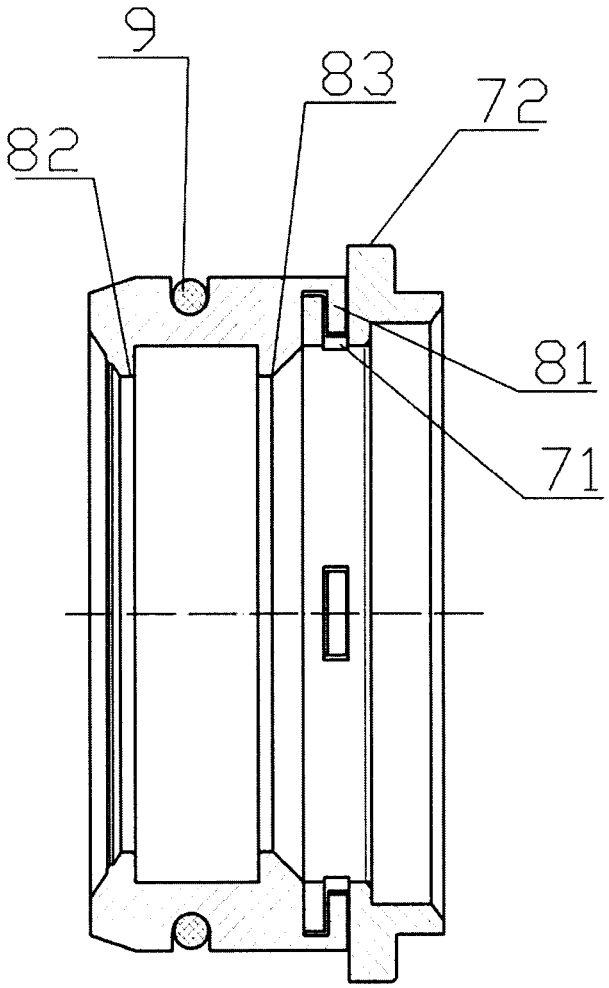
FIG. 5 is a sectional structural diagram of the cable clamp assembly of the present disclosure.
Figure 6:
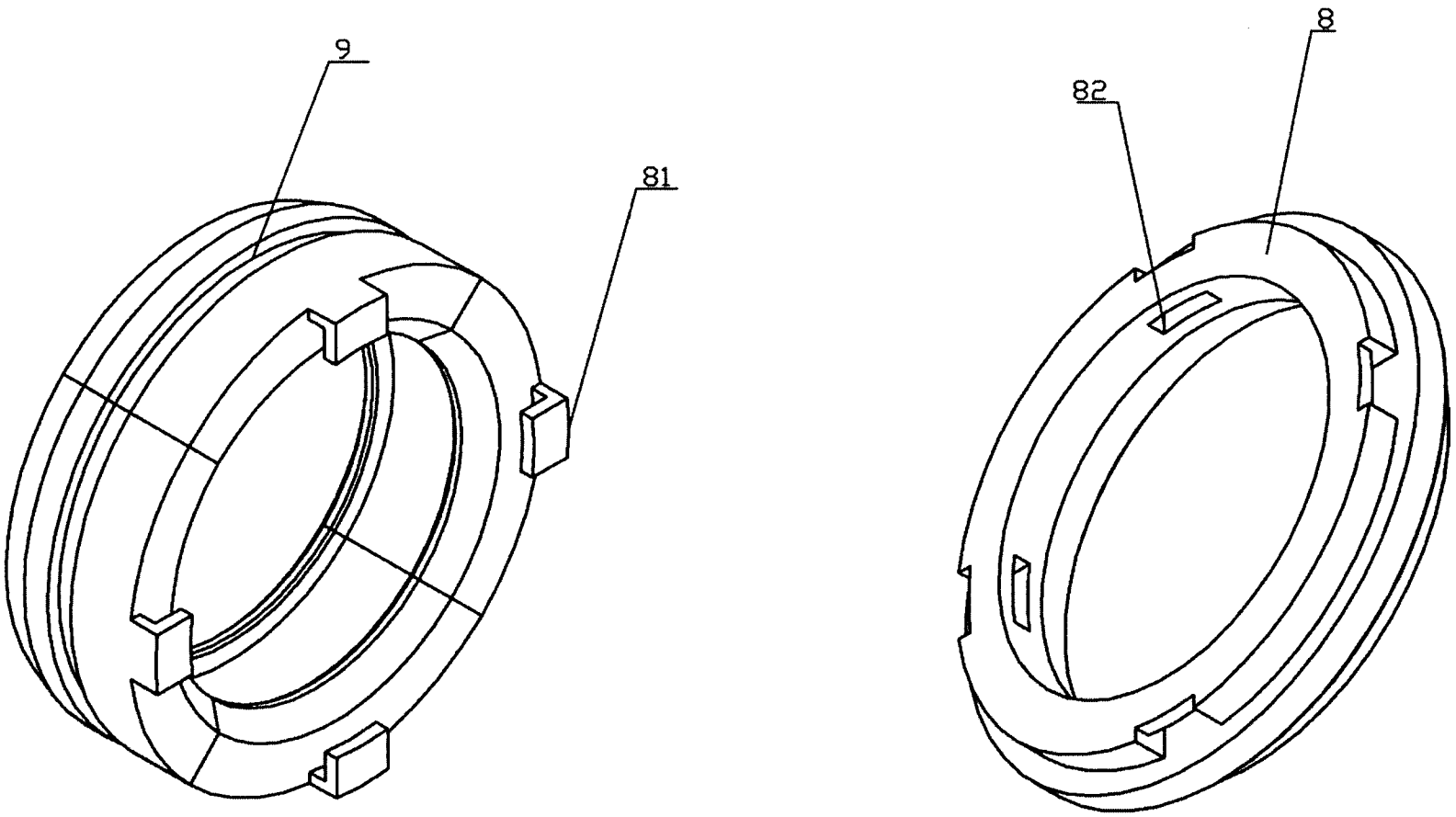
FIG. 6 is a schematic diagram showing a crimping effect of a sealing ring of the present disclosure.
Figure 7:
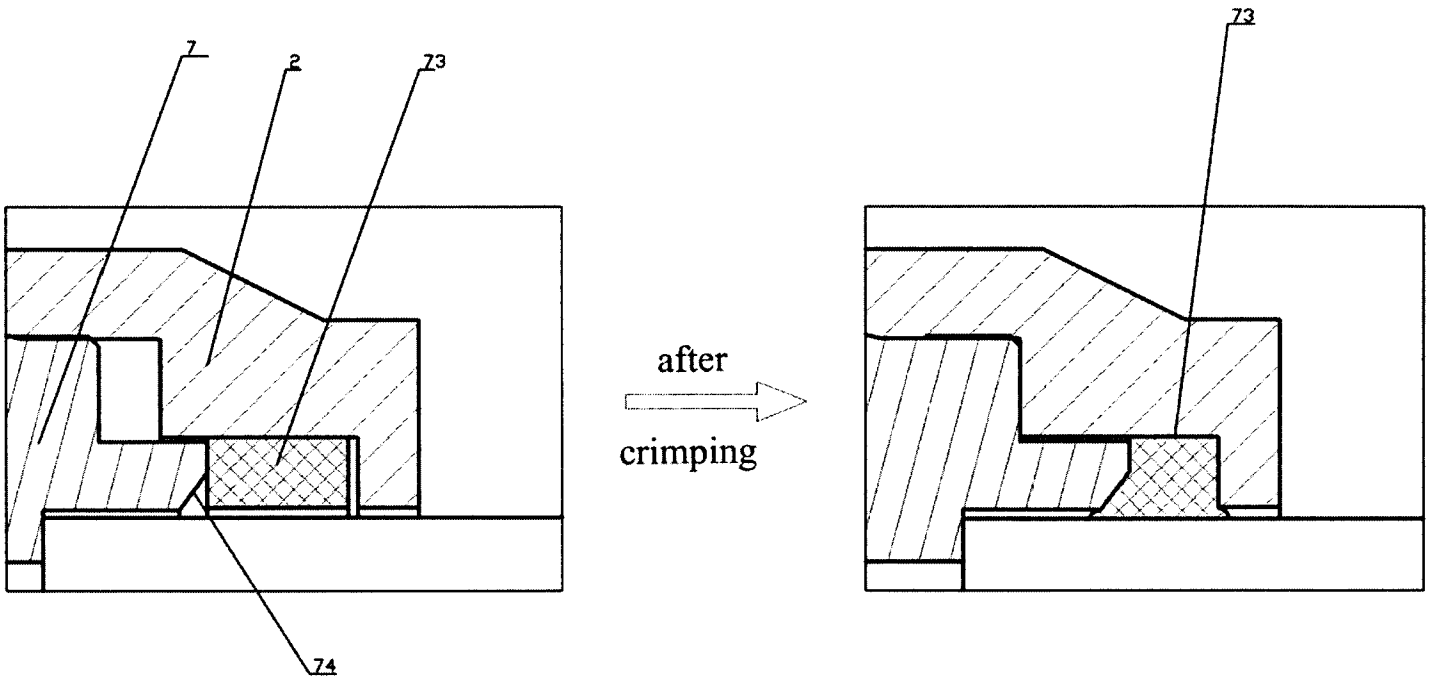
FIG. 7 is a schematic diagram showing a double-layer crimping effect upon an outer conductor of a cable.
Figure 8:
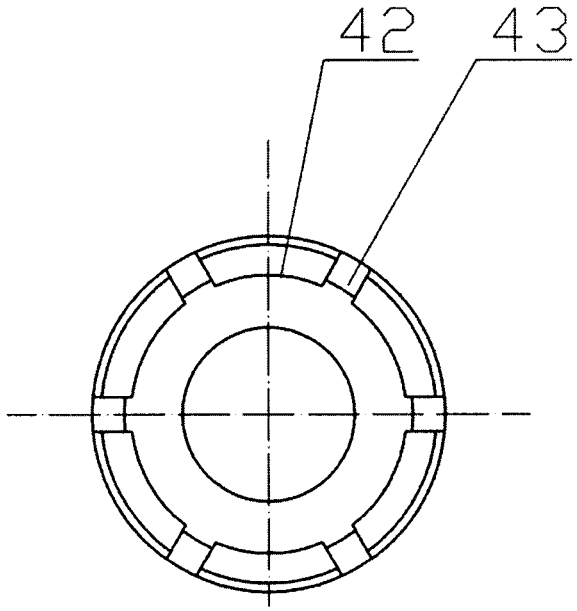
FIG. 8 is a schematic diagram of a front view of a central conductor of the present disclosure.
Figure 9:
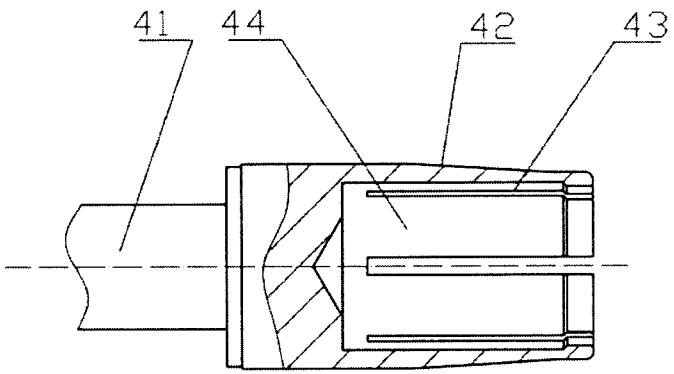
FIG. 9 is a schematic diagram of a partial sectional structure of the central conductor of the present disclosure.

Reference numerals are designated to the following components:

front shell 1, rear outer ring surface 11, clamping inner concave ring groove 12, sharp corner structure 13, stop protrusion 14, rear protective jacket 2, front inner ring surface 21, front insulator 3, first locating hole 31, central conductor 4, front protrusion 41, axial tail 42, open groove 43, penetration hole 44, cable clamp assembly 5, front end clamping surface 51, first sealing ring 6, base 7, slotted hole 71, axial rear protruded ring 72, sealing ring 73, slope 74, cable clamp 8, mounting hook structure 81, first inner ring protrusion 82, second inner ring protrusion 83, cable clamp structure 801, cable clamp fastening ring 9, cable 10, inner conductor 101 of cable and outer conductor 102.

DETAILED DESCRIPTION OF THE EMBODIMENTS

A quick demountable high-reliability radio-frequency coaxial connector, referring to FIG. 1 to FIG. 9, which comprises a front shell 1 and a rear protective jacket 2, a cavity of the front shell 1 is internally provided with a front insulator 3 and a central conductor 4, the front insulator 3 and the central conductor 4 are arranged in a front-rear sequence, a first locating hole 31 is formed in a central axial position of the front insulator 3, the center of the front end of the central conductor 4 is provided with a front protrusion 41, the front protrusion 41 is arranged towards the first locating hole 31, the outer ring surface of an axial tail 42 of the central conductor 4 is uniformly distributed with open grooves 43, a penetration hole 44 is formed in a central part of the axial tail 42 of the central conductor 4, the axial tail 42 of the central conductor 4 is specifically a necking conical structure. The inner diameter of the outer end of the necking conical structure is smaller than that of an inner conductor 101 of a cable, while the inner diameter of the inner end of the necking conical structure is larger than that of the inner conductor 101 of the cable. A rear outer ring surface 11 of the front shell 1 and a front inner ring surface 21 of the rear protective jacket 2 are located and connected by an interference fit, an inner cavity of the rear protective jacket 2 is internally provided with a cable clamp assembly 5, a front end clamping surface 51 formed by the cable clamp assembly 5 is used for clamping an outer ring surface of an outer conductor 102 of a to-be-connected cable 10, a clamping inner concave ring groove 12 which is forwardly concave is formed in the inner side of a rear end inner ring surface of the front shell 1, and a lock catch part of the clamping inner concave ring groove 12 is of a backwardly sharp corner structure 13 as can be seen from a cross-section view of the coaxial connector in FIG. 2, the sharp corner structure 13 can be seen as a sharp annular/ring edge structure along the axis of the coaxial connector, as shown in FIG. 1.

The inner side of a stop protrusion 14 on the rear outer ring surface 11 of the front shell 1 is sleeved with a first sealing ring 6, and an outer ring surface of the first sealing ring 6 abuts to an inner ring surface 21 of the rear protective jacket 2 after the cable 10 is connected in place so that in-place packaging is achieved.

The front protrusion 41 is connected with the first locating hole 31 by an interference fit at a mounting state.

The cable clamp assembly 5 comprises a base 7 and a cable clamp 8, an outer ring surface of the base 7 is connected with the corresponding inner ring surface of the rear protective jacket 2 by an interference fit, mounting hook structures 81 at the rear end of the cable clamp 8 are clamped in slotted holes 71 in the corresponding outer ring surface of the base 7, each of the front and rear of the inner end ring surface of the cable clamp 8 is provided with a first inner ring protrusion 82 and a second inner ring protrusion 83, the first inner ring protrusion 82 and the second inner ring protrusion 83 are used for crimping corresponding troughs of the cable mounted in place, and the front end surface of the cable clamp 8 is a clamping surface 51 corresponding to the clamping inner concave ring groove 12 of the front shell.

The cable clamp 8 is specifically of a circular ring structure formed by circumferentially splicing a plurality of lobes of cable clamp structures 801, and mounting hook structures at the rear ends of the cable clamp structures 801 are located in corresponding slotted holes 71. In the specific embodiment, the four lobes of cable clamp structures 801 are circumferentially spliced to form the cable clamp 8 into a circular ring structure.

The inner wall of each of the cable clamp structures 801 from a sectional view comprises a first protrusion, an inner concave section and a second protrusion which form a clamping structure, the first protrusions of the plurality of cable clamp structures 801 are combined to form the first inner ring protrusion 82, and the second protrusions of the plurality of cable clamp structures 801 are combined to form the second inner ring protrusion 83.

The front end outer ring surface of the cable clamp 8 is sleeved with a cable clamp fastening ring 9, and an outer ring surface formed by the cable clamp 8 is pushed into an inner cavity at the rear end of the front shell 1 after the cable is connected in place.

The base 7 comprises an axial rear protruded ring 72 inserted into a mounting groove corresponding to a rear mounting sleeve 2, a sealing ring 73 is arranged between the rear end of the axial rear protruded ring 72 and the inner end wall of the mounting groove, and an inner ring surface of the sealing ring 73 simultaneously sleeves an outer sheath ring surface of the to-be-connected cable 10 in a working state, so that the waterproof performance is achieved.

A gap is remained between the rear end surface of a main body of the base 7 and the corresponding locating end surface of the rear mounting sleeve 2 during pre-mounting, a section of a rear end inner ring surface of the axial rear protruded ring 72 is a slope 74, and the rear end surface of the main body of the base 7 and the locating end surface of the rear protective jacket 2 are used as limiting surfaces in a crimping process, so that the sealing ring 73 is deformed under force in the crimping process to achieve a sealing effect.

The working principle is as follows: firstly, the cable is subjected to wire stripping and is pre-mounted, then, the cable is inserted into a coaxial connector from a central hole of the rear protective jacket, the inner conductor of the cable has to be in the penetration hole of the axial tail of the central conductor, the inner conductor of the cable has to enter the penetration hole of the central conductor and be concentric therewith, next, the outer conductor of the cable abuts against the sharp corner structure in the crimping process, the outer conductor of the cable is extruded to bend and deform, and thus being overlapped and clamped between the front end clamping surface of the cable clamp assembly and the clamping inner concave ring groove, the cable displaces when a crimping force acting on the cable is large enough, meanwhile, the central conductor is driven along and pushed forwards, and thereby, the central conductor is driven to enter the first locating hole, so that the inner conductor of the cable is better fastened.

The quick demountable high-reliability radio-frequency coaxial connector is mainly suitable for a cable with an inner conductor being of a copper pipe structure and has the following characteristics:

1. The connector is of an integrated structure after being completely mounted and is not needed to be separated in a construction process, and the cable is only needed to be pushed to a preset position.

2. The cable clamp is of a multi-lobed structure and is protected by a "hook-like" structure and an O-shaped ring to form a cable clamp assembly when being placed on the base, so that expansion and contraction in a cable placing process can be realized, in addition, the cable clamp is fixedly arranged on the rear shell, so that the cable clamp is prevented from dropping due to a positional limitation by the inner wall of the rear shell in a strutting process.

3. The cable clamp has a double-trough fixing function, by a semicircular groove formed in the surface of the cable clamp.

4. The inner conductor of the connector has a certain conicity so as to be capable of smoothly entering into the inner conductor of the cable, and the contact between the inner conductor of the connector and the inner conductor of the cable is elastic contact.

5. The cable can be pulled out at any time in a mounting process of the connector, so that scrapping of the connector caused by mounting problems can be avoided.

6. The crimping of the cable clamp to the outer conductor, is applied, such that the outer conductor is crimped into a dual-layer of copper strips, instead of former single-layer clamping, so as to be clamped more firmly.

7. The connector is mounted by crimping the front shell and the rear shell by an interference fit instead of a conventional screwed structure, and meanwhile, proved by tests, the tensile strength obtained by connecting with the cable is obviously higher than that of the conventional screwed structure.

8. An inner insulating support has high-strength horizontal and longitudinal performances and also meets the requirement for electrical properties of a radio-frequency connector.

9. The sealing ring at the tail end of the connector is compressed to deform in the crimping process and is in tight contact with the sheath of the cable so that a waterproof effect is achieved.

Specific embodiments of the present disclosure are described in detail above, but contents are only suitable embodiments of the present disclosure and cannot be construed as a limitation of the present disclosure. Equivalent variations, improvements and the like made within the scope of the present disclosure should still fall into the scope of patent.

The invention claimed is:

1. A quick demountable high-reliability radio-frequency coaxial connector, comprising:

a front shell comprising:

a rear outer ring surface;

a rear end inner ring surface;

a cavity;

a clamping inner concave ring groove forwardly concave and formed in an inner side of the rear end inner ring surface, wherein the clamping inner concave ring groove having a lock catch part being of a backward sharp corner structure;

a front insulator provided in the cavity of the front shell, having a first locating hole formed in a central axial position of the front insulator;

a central conductor provided in the cavity of the front shell, arranged with the front insulator in a front-rear sequence, comprising:

a front end provided in the cavity, comprising a front protrusion provided at a center of the front end of the central conductor, arranged towards the first locating hole;

an axial tail having an outer ring surface and being of a necking conical structure, comprising:

a central part having a penetration hole formed therein;

an outer end of the necking conical structure, having an inner diameter smaller than that of an inner conductor of a cable;

an inner end of the necking conical structure, having an inner diameter larger than that of the inner conductor of the cable;

open grooves uniformly distributed on the outer ring surface;

a rear protective jacket having an inner cavity, and a front inner ring surface connected with the rear outer ring surface of the front shell by an interference fit; and a cable clamp assembly provided in the inner cavity of the rear protective jacket, having a front end clamping surface used for clamping an outer ring surface of an outer conductor of the cable to-be-connected, wherein the cable clamp assembly comprises:

a base having an outer ring surface connected with a corresponding inner ring surface of the rear protective jacket by an interference fit, and having slotted holes in the outer ring surface;

a cable clamp having:

mounting hook structures at a rear end of the cable clamp, wherein the mounting hook structures are clamped in the slotted holes in the corresponding outer ring surface of the base;

a first inner ring protrusion and a second inner ring protrusion provided at front and rear of an inner end ring surface of the cable clamp, wherein the first inner ring protrusion and the second inner ring protrusion are used for crimping corresponding troughs of the cable mounted in place; and a front end surface being a clamping surface corresponding to the corresponding clamping inner concave ring groove of the front shell.

2. The quick demountable high-reliability radio-frequency coaxial connector of claim 1, wherein the rear outer ring surface of the front shell having a stop protrusion, an inner side of the stop protrusion is sleeved with a first sealing ring having an outer ring surface, and the outer ring surface of the first sealing ring abuts to an inner ring surface of the rear protective jacket after the cable is connected in place.

3. The quick demountable high-reliability radio-frequency coaxial connector of claim 1, wherein the front protrusion is connected with the first locating hole by an interference fit in a mounting state.

4. The quick demountable high-reliability radio-frequency coaxial connector of claim 1, wherein the cable clamp is specifically of a circular ring structure formed by circumferentially splicing a plurality of lobes of cable clamp structures, and the mounting hook structures at the rear ends of the cable clamp structures are located in the corresponding slotted holes.

5. The quick demountable high-reliability radio-frequency coaxial connector of claim 4, wherein an inner wall of each of the cable clamp structures from a sectional view comprises a first protrusion, an inner concave section and a second protrusion which together form a clamping structure, the first protrusions of the plurality of cable clamp structures are combined to form the first inner ring protrusion, and the second protrusions of the plurality of cable clamp structures are combined to form the second inner ring protrusion.

6. The quick demountable high-reliability radio-frequency coaxial connector of claim 5, wherein the front end outer ring surface of the cable clamp is sleeved with a cable clamp fastening ring, and an outer ring surface formed by the cable clamp is pushed into an inner cavity at the rear end of the front shell after the cable is connected in place.

7. The quick demountable high-reliability radio-frequency coaxial connector of claim 4, wherein the front end outer ring surface of the cable clamp is sleeved with a cable clamp fastening ring, and an outer ring surface formed by the cable clamp is pushed into an inner cavity at the rear end of the front shell after the cable is connected in place.

8. The quick demountable high-reliability radio-frequency coaxial connector of claim 1, wherein the base comprises an axial rear protruded ring inserted into a mounting groove corresponding to a rear mounting sleeve, a sealing ring is arranged between the rear end of the axial rear protruded ring and the inner end wall of the mounting groove, and an inner ring surface of the sealing ring simultaneously sleeves an outer ring surface of a sheath of the to-be-connected cable in a working state.

9. The quick demountable high-reliability radio-frequency coaxial connector of claim 8, wherein a gap is remained between a rear end surface of a main body of the base and a corresponding locating end surface of the rear mounting sleeve during a pre-mounting process, a cross-section of a rear end inner ring surface of the axial rear protruded ring is a slope, and the rear end surface of the main body of the base and the locating end surface of the rear protective jacket are used as limiting surfaces in a crimping process, so that the sealing ring is deformed under force in the crimping process.

* * * * *